United States Patent [19]

Takahashi et al.

[11] 4,314,017

[45] Feb. 2, 1982

[54] DEVELOPER WITHOUT CARRIER POWDER HAVING AN IMPROVED TRIBOELECTRIC CHARGING PROPERTY

[75] Inventors: Tohru Takahashi; Tsutomu Toyono; Junichiro Kanbe, all of Tokyo; Shunji Nakamura; Yasuyuki Tamura, both of Kawasaki, all of Japan

[73] Assignee: Canon Kabushiki Kaisha, Tokyo, Japan

[21] Appl. No.: 5,018

[22] Filed: Jan. 19, 1979

[30] Foreign Application Priority Data

Jan. 26, 1978 [JP] Japan ..... 53-7705

[51] Int. Cl.[3] ..... G03G 9/08

[52] U.S. Cl. ..... 430/109; 430/107; 430/110

[58] Field of Search ..... 252/62.1 P; 96/15 D; 427/14; 430/109, 110, 111, 903, 904, 107

[56] References Cited

U.S. PATENT DOCUMENTS

| | | | |
|---|---|---|---|
| 2,221,776 | 11/1940 | Carlson | 430/107 |
| 2,297,691 | 10/1942 | Carlson | 430/107 |
| 2,618,552 | 11/1952 | Wise | 430/120 |
| 2,874,063 | 2/1959 | Greig | 430/109 |
| 3,959,404 | 5/1976 | Labawa et al. | 430/109 |
| 3,974,078 | 8/1976 | Crystal | 430/109 |
| 4,070,296 | 1/1978 | Gibson et al. | 252/62.1 P |
| 4,134,760 | 1/1979 | Gibson et al. | 252/62.1 P |
| 4,142,981 | 3/1979 | Bean et al. | 252/62.1 P |
| 4,148,640 | 4/1979 | Dulmage et al. | 252/62.1 P |

*Primary Examiner*—Richard C. Schilling
*Assistant Examiner*—John L. Goodrow
*Attorney, Agent, or Firm*—Fitzpatrick, Cella, Harper & Scinto

[57] ABSTRACT

A developer is composed of colored insulating particles for developing an electrostatic image wherein at least the external surface of each particle comprises two different areas of which one area constitutes a major portion of said external surface and comprises an element which defines the polarity of the triboelectric charge of said particle to a determined polarity while the other area comprises an element capable of being easily separated from said particle, transferred to a surface of a developing device and charged to a polarity opposite to that of said particle.

12 Claims, 3 Drawing Figures

DEVELOPER WITHOUT CARRIER POWDER HAVING AN IMPROVED TRIBOELECTRIC CHARGING PROPERTY

BACKGROUND OF THE INVENTION

1. Field of the Invention

The present invention relates to a single-component developer for developing a so-called electrostatic or magnetic latent image formed in an electrophotographic, electrostatic printing, magnetic printing or electrostatic recording process.

2. Description of the Prior Art

In the field of image forming processes there are already known various photographic, recording and printing processes comprising the step of rendering an electrostatic or magnetic latent image visible by means of fine colored particles called toner.

For example, the electrophotographic processes, as disclosed in the U.S. Pat. No. 2,297,691, Japanese Patent Publication Nos. Sho 42-23910 and Sho 43-24748, generally comprise steps of forming an electrostatic latent image by various means on a photosensitive member utilizing a photoconductive material, developing said latent image with toner, transferring, if necessary, the thus obtained toner image onto a transfer material such as a paper sheet, and fixing said toner image by heat, pressure or a solvent vapor to obtain a completed copy. For rendering an electrostatic latent image visible with toner there are already known, for example, a magnetic brush developing method as disclosed in U.S. Pat. No. 2,874,063, a cascade developing method as disclosed in U.S. Pat. No. 2,618,552, and a powder cloud developing method as disclosed in U.S. Pat. No. 2,221,776. The developers to be employed in such developing methods are classified into a either single-component developer solely composed of fine colored particles, generally called toner, adapted to be more or less selectively attracted or repelled by the electrostatic charge, or a two-component developer composed of a mixture of such toner particles with carrier particles such as iron powder or glass beads. In the latter two-component developer the insulating toner particles are charged by frictional charging caused by mixing the toner particles with the carrier particles and thus are deposited on the electrostatic image. Also in the former single-component developer the toner particles are deposited on the electrostatic image by a charge induced by a conductive material such as a magnetic metal sleeve for holding said toner particles, by a corona charging or by a frictional charging.

Among the developing methods utilizing such single-component developer consisting solely of toner particles, already known is the so-called charge induction developing method as disclosed, for example, in Japanese Patent Publication No. Sho 37-491. In this method electroconductive magnetic toner particles are adhered to a sleeve containing a magnet to form a magnetic brush which is maintained in contact with a member for carrying the electrostatic latent image thereon to develop said latent image with said toner. In such developing method, since the toner particles are electroconductive, a charge of a polarity opposite to that of the electrostatic latent image is induced in said toner particles when the magnetic brush is brought into facing relationship with the electrostatic latent image, whereby the development thereof is achieved by the electrostatic attraction between the latent image and the toner wherein the electrostatic charge is thus induced.

Such charge induction developing method is advantageous in that the developer, being solely composed of toner particles, does not require the adjustment of the toner concentration or the mixing ratio with the carrier particles, that the developing apparatus can be rendered compact and simple as the method does not require an agitating step for charging the developer, and that said method is free from deterioration of the quality of developed image resulting from deterioration of the carrier particles caused with the lapse of time. Despite such advantages, the charge induction developing method has been applied only to a process of forming an electrostatic latent image on a photosensitive paper coated with a photosensitive material such as zinc oxide and directly developing said latent image with the toner.

Although the image forming processes comprising a step of transferring the developed image onto a suitable transfer material such as a plain paper sheet have been widely used in recent years, the application of the above-mentioned charge induction developing method to such image forming processes is extremely difficult and disadvantageous, as the transfer step is subjected to various limitations due to the electrical conductivity of the toner particles.

More specifically, for example, in an electrostatic transfer method such as a corona transfer method in which a transfer material is maintained in contact with the member carrying the electrostatic latent image and a corona discharge is applied from the back side of said transfer material to achieve the transfer of image, the electroconductive toner particles are charged to the same polarity as that of the transfer material by a weak corona current penetrating the transfer material, whereby not only is the transfer achieved insufficiently but also the mutual repulsion between the toner particles in the toner layer thus charged to the same polarity leads to a distortion of the developed image.

Also among the developing methods utilizing a single-component developer there is already known a method utilizing insulating toner, in which toner particles are absorbed or applied on a surface of a sheet or a roller (hereinafter called "toner supporting surface") to form a toner layer which is brought into a close facing relationship or into contact with a surface carrying an electrostatic latent image thereon, thereby achieving the development. In this method the toner particles are charged either by a corona discharge or by frictional charging between the toner particles and the toner supporting surface or a surface of the developing apparatus. It is, however, difficult to achieve a uniform charging of the toner particles by a corona discharge while the frictional charging is hardly capable of providing a sufficient and stable charging as the frequency of contact of the toner particles with the surface of apparatus is much less than the frequency of contact of the toner particles with the carrier particles in a two-component developer. Although the charging of toner particles can be intensified to a certain extent by coating the toner supporting surface with a material to be charged to the opposite polarity upon friction contact with the toner particles, such measure is defective since toner particles are gradually deposited on the toner supporting surface or other surfaces by physical adhesion other than the electrostatic attraction to hinder frictional charging and also since such material is gradually abraded to lose the charging ability.

SUMMARY OF THE INVENTION

According to the present invention, there is provided a developer composed of colored insulating particles for developing an electrostatic image wherein at least the external surface of each particle comprises two different areas of which one area constitutes a major portion of said external surface and comprises an element which defines the polarity of the triboelectric charge of said particle to a determined polarity while the other area comprises an element capable of being easily separated from said particle, transferred to a surface of a developing device and charged in a polarity opposite to that of said particle.

The object of the present invention is to provide a single-component developer or toner for an electrostatic latent image capable of eliminating the above-mentioned drawbacks associated with the use of conventional insulating toners.

Another object of the present invention is to provide a single-component developer for an electrostatic image capable of efficiently developing an electrostatic latent image to obtain a developed image of an elevated quality.

Still another object of the present invention is to provide a developer for an electrostatic image allowing to perform the transfer step efficiently within a short time and with a high precision.

In a developing method utilizing the developer of the present invention, a material adapted to be charged in a polarity opposite to that of the toner particles upon friction therewith is liberated from said toner particles and transferred onto the toner supporting surface and other surfaces of the developing apparatus, whereby the frictional charge on the toner particles can be made stronger and stably controlled.

These and other objects and advantages of the present invention will be made fully apparent from the following explanation taken in conjunction with the attached drawings.

DESCRIPTION OF THE PREFERRED EMBODIMENT

In the following there will be given an explanation on the method of liberating, from toner particles consisting of a major area comprising an element capable of controlling the charge of said toner particles either positively or negatively and a minor area comprising an element capable of being charged in an opposite polarity upon friction with said major area, the latter element to coat a surface contacting the toner particles such as a surface of a developing device, a toner supporting surface (e.g. a developing roller surface) and the like and to stabilize the frictional charge on the toner particles coming into frictional contact with said surfaces.

Figure 1:
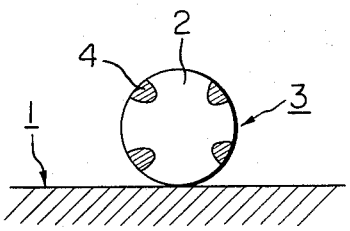
FIGS. 1, 2 and 3 are schematic cross-sectional views showing different embodiments of the developer of the present invention.

In FIG. 1 there are shown a toner supporting surface 1 of an arbitrary shape such as a sheet or a roller; a material 2 constituting the major portion of the insulating toner particle 3 and selected so as to charge the toner particle 3 to a desired polarity upon friction contact with said toner supporting surface 1. Said material 2 may contain so-called charge control materials (hereinafter referred to as "charge control material A") and a different material 4 partially exposed on the surface of the toner particle 3 and selected from substances located apart from said charge control material A in the frictional charge series and thus frictionally charged in a polarity opposite to that of said toner particle 3, said material 4 being hereinafter referred to as "charge control material B". The examples of said charge control material A are various binders for toner already known in the art, for example, styrene or substituted-styrene homopolymers such as polystyrene, poly-p-chlorostyrene or polyvinylstyrene, styrenic copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl alpha-chloromethacrylate copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, styrene-acrylonitrile-indene copolymer etc., polymethyl methacrylate, polybutyl methacrylate, polyvinyl chloride, polyvinyl acetate, polyethylene, polypropylene, polyester, polyurethane, polyamide, epoxy resin, polyvinylbutyral, polyamide, polyacrylic resin, modified rosin, terpene resin, phenolic resin, aliphatic or alicyclic hydrocarbon resin, aromatic petroleum resin, chlorinated paraffin, paraffin wax etc. which can be employed singly or in combinations. The above-mentioned material may contain various known dyes or pigments as the coloring agent, such as carbon black (C.I. 77266), nigrosine (C.I. 50415), iron oxide black, metal complex salt dyes, chromium yellow (C.I. 14095, 14025), Hansa yellow (C.I. 11680, 11710), benzidine yellow (C.I. 21090, 21095, 21100), red iron oxide, qunacridone pigments (C.I. Pigment Red 122), rhodamine pigments (C.I. Pigment Red 81), aniline red, Brilliant Carmine (C.I. 15850), prussian blue, ultramarine, phthalocyanine blue (C.I. 74160, 74180, 74100) etc. In the preparation of the toners of yellow, magenta or cyan color particularly preferred is the use of the following dyes.

For obtaining yellow toner particularly preferred are benzidine yellow organic pigments (3,3'-dichlorobenzidine derivatives). The examples of the preferred pigments are Color Index 21090 commercially known as Pigment Yellow 12 of Symuler Fast Yellow GF, C.I. 21095 commercially known as Pigment Yellow 14, Benzidine Yellow G, Benzidine Yellow I.G., Vulcan Fast Yellow G, Benzidine Yellow OT or Symuler Fast Yellow 5GF, C.I. 21100 commercially known as Pigment Yellow 13, Benzidine Yellow GR, Permanent Yellow GR or Symuler Fast Yellow GRF, monoazo dyes such as C.I. Solvent Yellow 16, and nitrophenylamine sulfoneamide known as C.I. Disperse Yellow 13.

For obtaining magenta toner preferred are quinacridone magenta organic pigments and rhodamine magenta organic pigments. The examples of such pigments are Pigment Red C.I. 122 commercially known as Permanent Pink E or Fastgen Super Magenta RS, Pigment Red C.I. 81 known commercially as Seikalight Rose 81, Symulex Rhodamine Y or Orgalite Brillred TCR, anthraquinone dyes, diazo dyes commercially known as C.I. Solvent Red 19.

For obtaining cyan toner preferred are phthalocyanine blue organic pigments. The examples of such pigments are copper phthalocyanine known commercially as C.I. Pigment Blue 15, Indanthrene Blue, C.I. 74100, 74250, 74260, 74280, 74255, 74160, 74180 etc.

Also some of such pigments and dyes function as a charge regulating material. For example, the aforementioned resins are given a positively charging property by nigrosine, Pigment Fast Black B (C.I. 1361), Helio Fast Blue (C.I. 1188), triphenylmethane compounds, rhodamine dyes, copper phthalocyanine compounds, polyvinylpyridine, dimethylaminoethyl methacrylate etc. Also the aforementioned resins are given a negatively charging property by the metal-containing dyes disclosed in the Japanese Patent Publication Nos. Sho 41-20153, Sho 43-27596, Sho 44-6397 or Sho 45-26478, oxidized starch, metal-containing salicylic compounds, vinylidene chloride etc. The charging property can be further improved by adding such materials to the aforementioned charge control material A.

The charge control material B constitutes a minor area on the external surface of the developer particles and is composed of material easily liberated from said particles and transferred to the surface of the developing apparatus, and adapted to be charged in a polarity opposite to that of said particles. The charge control materials A and B are preferably selected so as to be mutually insoluble in order that said materials are independently present with a desired area ratio on the external surface of the developer particles. Also said charge control material B is preferably a soft substance and has an affinity to the surface of said developing apparatus in order to facilitate the liberation and transfer of the charge control material B from the developer particles to the surface of the developing apparatus. The adhesion of the charge control material B to the surface of the developing apparatus need not to be necessarily very strong, but may be of an extent enough to suppress the adhesion of the material A or may be stronger than the adhesion of the material A. In order that the charge control material B adhered to the surface of the developing apparatus allows satisfactory development by charging the developer particles in the opposite polarity, the charge control material B is preferably located in a position, in the triboelectric series, well apart from that of said charge control material A, and the charging property of said charge control material B can be further enhanced by the addition of the aforementioned charge regulating materials. In this manner the charge control material B adheres to the surface of the developing apparatus during the course of development and is charged in a polarity opposite to that of the developer particles to support said particles on said surface thereby enabling satisfactory development. It is therefore rendered possible to prevent the conventionally unavoidable deterioration of the developing ability resulting from the deposition of a substance constituting the developer particles and thus of the same charging polarity as that of said particles. Said charge control materials A and B and the material constituting the developing apparatus preferably occupy positions, on the triboelectric series, arranged in the order of said material A, the material constituting the developing apparatus and said material B, whereby the developer particles containing the charge control material A assumes a charge potential higher with respect to the charge control material B deposited onto the surface of the developing apparatus than with respect to said developing apparatus itself, thus assuring a better development when such deposition takes place. The developing apparatus or toner support member, such as a developing roller, can be composed, for example, of aluminum, stainless steel, iron, rubber or a plastic material.

In the present invention, the combination of the charge control materials A and B is selected in consideration of the surface area ratio thereof on the toner particles and of the strength of friction charging in such a manner that the polarity of triboelectric charge of the entire toner particle 3 is identical with that of said charge control material A. Said surface area ratio of the charge control materials A to B is selected within a range from 5:1 to 500:1, preferably from 10:1 to 100:1. Also the toner support surface 1 or other surfaces of the developing apparatus is so designed as to achieve selective deposition of the charge control material B in consideration of the difference in surface tension or in hardness of said materials A and B. For example, in case the charge control material A is to be charged positively, the charge control material B can be composed of a resin softer than the resin employed in said material A or a wax such as carnauba wax, Japan tallow or paraffin wax added with a negative charge control material.

The above-mentioned composition of the toner particle 3 allows to constantly maintain the charging property of the entire toner particles by the friction, for example, with a toner supporting surface even in a development of an electrostatic latent image solely with toner particles.

As the charge control material B contained in the toner particles of the present invention is easily transferable and depositable onto other surfaces, there can be considered a possibility that said material B covers the entire surface of the toner particles during the use thereof to change the polarity of triboelectric charge of the toner particles to that of said material B which is not suitable for conducting the development. However, in practice, such drawback is extremely little since the toner particles are gradually consumed and replaced by new ones and also since such covered particles, even if actually formed, will not be attracted by the electrostatic latent image and thus will not contribute to the development.

In the use of the toner of the present invention, it is preferable to coat the toner support surface 1 etc. with a material similar to the charge control material B contained in the toner particles in order to increase the affinity with said material B and thus to facilitate the transfer thereof.

Figure 2:
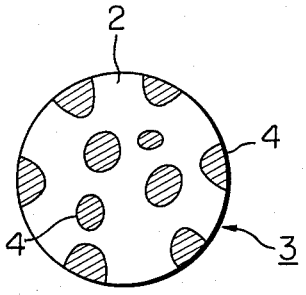
Figure 3:
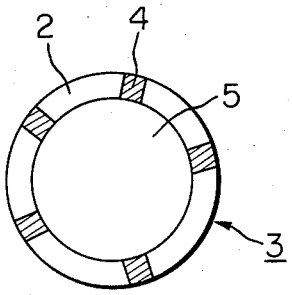

The structure of the toner particle 3 is not limited to that shown in FIG. 1, but is also modifiable as shown in schematic cross-sectional views in FIGS. 2 and 3, wherein like members are represented by like numbers. In the embodiment shown in FIG. 2 the charge control material B is dispersed in the charge control material A throughout the entire volume of the toner particle, while in the embodiment shown in FIG. 3 the charge control material B is distributed in the charge control material A exclusively at the external surface of the toner particle whereas an internal core 5 is composed of either the material A or the material B or another substance such as a soft material for pressure fixation. Said soft material for pressure fixation is preferably capable of adhering to the fibers of a plain paper under a linear pressure in the order of 20 kg/cm, and is composed of, for example, polyolefins such as polyethylene, polypropylene, polytetrafluoroethylene, and the like, ethylene copolymers such as ethylene-vinyl acetate copolymer, ethylene-acrylic compound copolymer, and the like, polyesters, styrenic resins such as polystyrene, styrene-butadiene copolymer, styrene-acrylic compound copolymer, and the like, higher fatty acids such as palmitic acid, stearic acid, lauric acid, and the like, polyvinyl pyrrolidone, epoxy resins, phenolterpene copolymers, silicone resins, maleic acid-modified phenolic resins or methyl vinyl ether-maleic anhydride copolymer, and the like.

In a further modification of the toner of the present invention (not shown in the drawing), the charge control material B, if it is composed of a soft material, can be utilized as a fixation accelerator in pressure fixation of the toner particles. In such case, the soft material should not be exposed to the external surface in a large amount, but should be concealed inside the toner particles in order to prevent coagulation or agglomeration of toner particles in the developing apparatus, thereby improving the shelf life thereof.

It is also possible to add, to the toner particles, a magnetic material such as magnetite, preferably in an amount not excessively increasing the electroconductivity of the entire toner. Said magnetic material may be any magnetic or magnetizable substance, for example, powdered metal such as iron, manganese, nickel, cobalt, chromium, and the like, various ferrites and manganese alloys or compounds. In such case, it is advantageously rendered possible to magnetically support the toner on the developing roller by providing a magnet inside said developing roller, and to effectively achieve the frictional charging of the toner particles by displacing the toner particles on said developer roller by means of rotating said magnet.

The advantages of the present invention explained in the foregoing description are summarized in the following:

(1) The toner particles of the present invention have a surface containing two charge control materials A and B which are positioned mutually well apart on the triboelectric series. The material A governs the polarity of charge of the entire particle by means of the occupying area or the strength of triboelectric charge thereof while the material B is easily liberated and transferred to a surface coming into contact with said toner particles to control the charge of the toner particles to a desired polarity by means of friction therewith.

Therefore, the toner particles of the present invention can maintain a stable triboelectric charge for a prolonged period since the material B stabilizes and intensifies the charging property of the toner particles despite a limited contact area with the toner particles in comparison with the case of a two-component developer.

(2) The toner particles of the present invention are insulating and therefore, these particles enable easy and exact electrostatic transfer (for example, by a corona discharge) of the developed image.

(3) Since it is not necessary to mix toner particles of the present invention with carrier particles, the toner particles are free from deterioration with the lapse of time, associated with the two-component developers as explained in the foregoing.

(4) The toner particles of the present invention do not require charging by a corona discharge though the toner particles are insulating. Therefore, no corona charger is necessary and thereby a structure of the developing apparatus can be simple.

(5) The toner particles of the present invention are also usable as toner for pressure fixation.

(6) Defective development resulting from a layered deposition of toner particles on the surface of developing apparatus can be avoided since the charge control material B alone is deposited on said surface while the toner particles principally composed of the charge control material A of the opposite polarity are attracted to the latent image.

(7) The charge control material B is easily transferable to other surfaces, and therefore, it is transferred also to the surface carrying the electrostatic latent image from which it is again transferred to a cleaning member such as a fur brush thereby improving the toner attracting function thereof. Also the charge control material B transferred to said image carrying surface functions for reducing the abrasion of the blade cleaner.

The present invention will be further clarified by the following examples, in which parts are by weight unless otherwise specified.

EXAMPLE 1

Following materials were blended and ground to obtain a classified powder of a particle size of 5 to 15 microns (hereinafter called fraction a):

| | |
|---|---|
| polystyrene (average molecular weight 1500) | 100 parts |
| carbon black | 6 parts |
| 1:2 chromium complex dye (Zabon Fast Black; BASF) | 2 parts |
| magnetite (trade name EPT 1000; Toda Kogyo) | 33 parts |

Separately the following mixture was spray-dried to obtain powders of a particle size smaller than 1 micron (hereinafter called fraction b):

| | |
|---|---|
| Japan tallow | 1 part |
| alkylaminomethyl copper phthalocyanine | 0.01 parts |

100 parts of the fraction a and 1 part of the fraction b were sufficiently mixed in a ball mill not containing balls to obtain toner particles, which showed, under microscopic observation, the deposition of the fraction b with a very small covering area on the particles of the fraction a.

The toner thus obtained was supported on an aluminum magnetic roller and utilized for the development of a positive electrostatic image. The quality of the developed image was satisfactory and showed no deterioration even after developments repeated 10,000 times. Also the developed image thus obtained could be exactly transferred onto a plain paper by means of a corona discharge. On the other hand a toner solely consisting of the fraction a only provided a developed image of an extremely low density under the same conditions.

The analysis of the material deposited on the magnetic roller after the development proved the presence of the fraction b alone.

EXAMPLE 2

The process of the Example 1 was repeated except that 1 part of carnauba wax in the fraction b was replaced by 2 parts of paraffin wax to obtain similar results.

EXAMPLE 3

110 parts of the fraction a in the Example 1 were maintained in agitation in an air jet mill and added with a mixture (called fraction c) of 10 parts of polyvinyl alcohol and 0.1 parts of a solution of polyvinylpyridine in acetic acid-water and spray dried to obtain toner particles, which were utilized in the development and transfer in a similar manner as in the Example 1 to obtain similar result therein.

EXAMPLE 4

50 parts of a phenolic resin, 50 parts of an epoxy resin, 10 parts of carbon black and 30 parts of magnetite were sufficiently blended (called fraction d) and added with a blended mixture (called fraction e) of 10 parts of carnauba wax and 2 parts of 1:2 chromium complex dye (Zabon Fast Black; BASF). The obtained product was crushed and classified to obtain toner particles of 5 to 15 microns, which showed, under a microscopic observation, the fraction e exposed in 3 to 8% of the surface area of the toner particles.

The toner particles thus obtained were supported on a stainless steel magnetic roller and utilized for the development of a negative electrostatic image to obtain similar results of development and transfer as in the Example 1.

EXAMPLE 5

100 parts of the fraction a in the Example and 10 parts of the fraction c in the Example 3 dried in fine granules were blended and ground to obtain classified toner particles of 5 to 15 microns, which were utilized in the development in a similar manner as in the Example 1.

The obtained results were further improved by coating the surface of the magnetic roller with polyvinyl alcohol.

What we claim is:

1. A developer without carrier powder and composed of colored insulating particles for developing an electrostatic image, wherein at least the external surface of each particle comprises two different areas of which one area constitutes a major portion of said external surface and comprises an element defining the polarity of the triboelectric charge of said particle to a determined polarity while the other area comprises an element capable of being easily separated from said particle, transferred to a surface of a developing device and charged in a polarity opposite to that of said particle, wherein the surface area ratio of said one area to said other area is within a range of 5:1 to 500:1.

2. A developer according to claim 1, wherein said element for defining the polarity of triboelectric charge and said element capable of being charged in the opposite polarity are positioned mutually well apart in the triboelectric series, that is, when said elements are rubbed together, one is positively charged while the other is negatively charged.

3. A developer according to claim 1, wherein said element for defining the polarity of triboelectric charge and said element capable of being charged in the opposite polarity are positioned in the triboelectric series on the opposite sides of a material used for the developing apparatus.

4. A developer according to claim 1, wherein the material constituting the area comprising the element defining the polarity of the triboelectric charge and the material constituting the area comprising the element capable of being charged in the opposite polarity are of a low mutual solubility.

5. A developer according to claim 1, wherein the area comprising the element capable of being charged in the opposite polarity comprises a charge control material included in an easily transferable material.

6. A developer according to claim 5, wherein said easily transferable material is a soft resin.

7. A developer according to claim 5, wherein said easily transferable material is a wax.

8. A developer according to claim 1, wherein the element capable of being charged in the opposite polarity is adhered on the surface the of colored insulating particles.

9. A developer according to claim 1, wherein the element capable of being charged in the opposite polarity is dispersed throughout the interior of the colored insulating particles.

10. A developer according to claim 1, wherein said element for defining the polarity of the triboelectric charge is a binder resin.

11. A developer according to claim 1, wherein said insulating particles comprise a soft material for pressure fixation.

12. A developer according to claim 1, wherein said insulating particles comprise a magnetic material.

* * * * *